US008677520B2

(12) United States Patent
Storm

(10) Patent No.: US 8,677,520 B2
(45) Date of Patent: Mar. 25, 2014

(54) FULL PERINEAL WASH SYSTEM

(76) Inventor: David B. Storm, Cookeville, TN (US)

( * ) Notice: Subject to any disclaimer, the term of this patent is extended or adjusted under 35 U.S.C. 154(b) by 1019 days.

(21) Appl. No.: 12/579,640

(22) Filed: Oct. 15, 2009

(65) Prior Publication Data

US 2010/0031433 A1 Feb. 11, 2010

(51) Int. Cl.
*A47K 3/022* (2006.01)

(52) U.S. Cl.
USPC ..... 4/578.1; 4/444; 4/447; 4/448; 4/571.1; 4/604; 297/45; 297/452.63; 297/DIG. 4

(58) Field of Classification Search
USPC ..... 4/420.4, 444, 447, 448, 560.1, 604, 4/578.1; 297/452.63, 45, DIG. 4
See application file for complete search history.

(56) References Cited

U.S. PATENT DOCUMENTS 3,995,326 A * 12/1976 Umann ..... 4/420.1
4,007,959 A * 2/1977 Juergens ..... 297/42
4,343,482 A * 8/1982 Wegner ..... 4/480
5,680,661 A 10/1997 Foster et al.
6,516,477 B1 2/2003 Storm
2007/0044222 A1* 3/2007 Hedberg ..... 4/321

* cited by examiner

*Primary Examiner* — Tuan N Nguyen
(74) *Attorney, Agent, or Firm* — Knox Patents; Thomas A. Kulaga

(57) ABSTRACT

Apparatus for a perineal wash system, including a seat with a pair of pads and/or a conduit that redirects fluid from a hand-held spray nozzle to the perineal area of a person on the seat. The pads are separated and have front and rear access areas dimensioned to allow a caregiver to access the perineal area of a seated person. In one embodiment one pad is movable sideways. The frame supporting the seat is spaced a sufficient distance from the gap between the pads to not impede access to the perineum. In one embodiment a perineal washer is supported adjacent the seat. The washer receives a nozzle of a hose sprayer and redirects the fluid spray through a movable elongated conduit to direct a spray of liquid upward to the perineum. In one embodiment a commode pot below the seat has a gap sufficient to avoid pinching dangling body parts.

19 Claims, 5 Drawing Sheets

Fig. 7
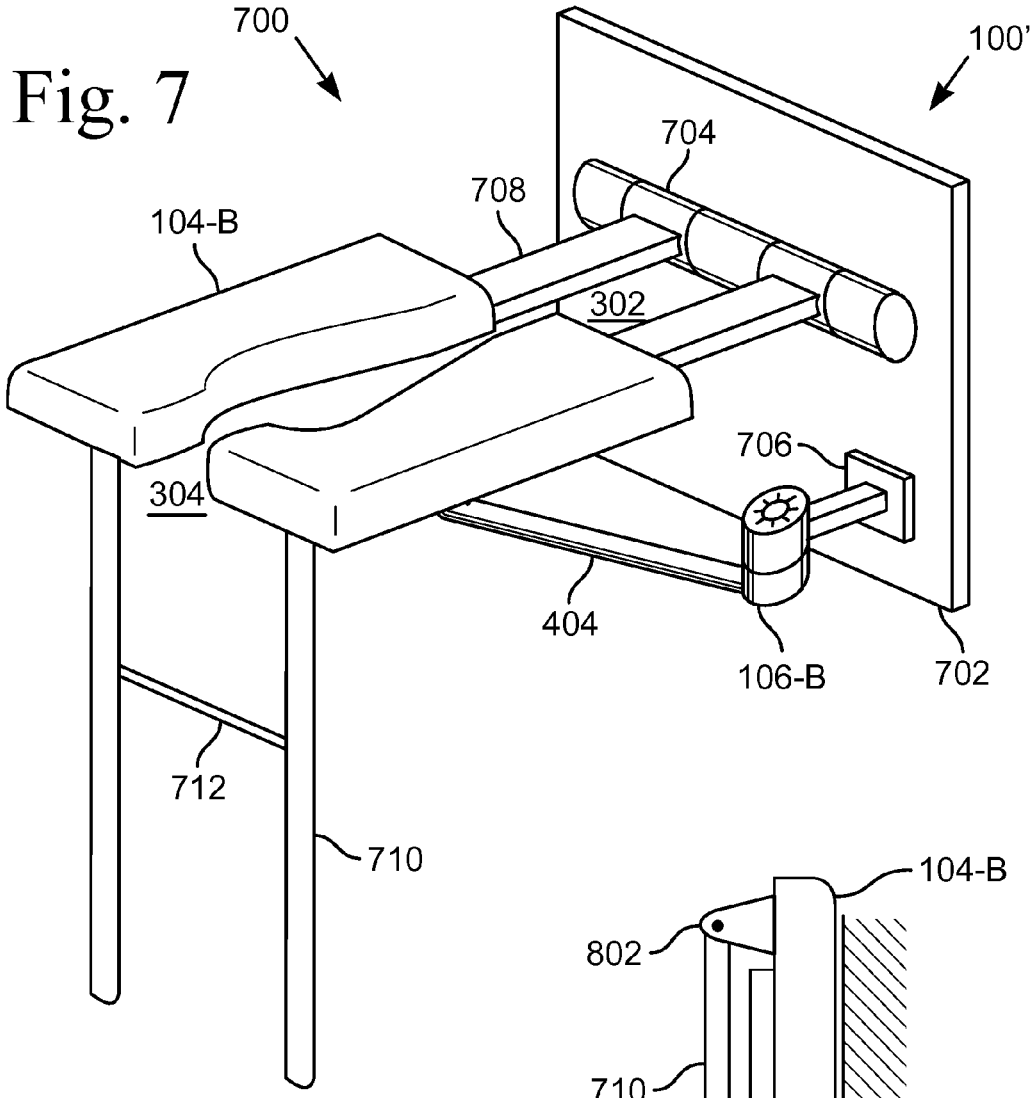
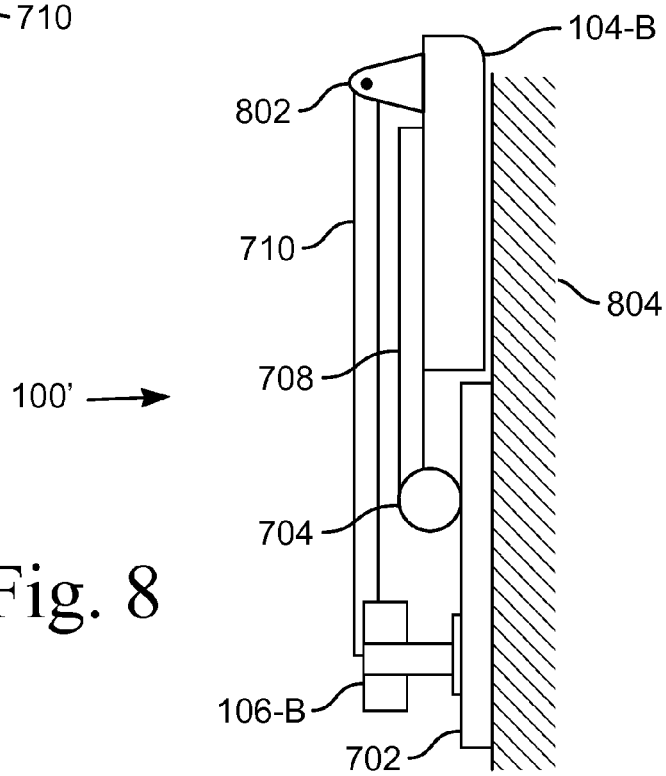
Fig. 8

FULL PERINEAL WASH SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a perineal wash system that provides for full access to the perineum of a seated person. More particularly, this invention pertains to a seat that allows a caregiver to fully access the perineal area of a person sitting in the seat and to a perineal washer that redirects fluid from a hand-held spray nozzle that redirects fluid to the perineal area of the seated person.

2. Description of the Related Art

Elder care facilities often provide hygienic care for its residents. Daily bathing in warm flowing water is both a hygienic and relaxing activity. Incontinent accidents commonly occur when persons are bathed in warm flowing water because of the relaxation of the body. Because the bathing areas in care facilities are often shared by multiple persons, it is not unusual for one person to come into contact with the waste of another person. For example, elderly persons are transported to a common wash area in a wheeled bath chair. The person is bathed while seated in the chair. Common bath chairs sometimes have a pot or bucket for catching fecal matter or other wastes from an incontinent person seated in the chair. These pots are not often used because of the pinching that occurs when the pot is removed with the person seated in the chair. Also, because the bath chair has wheels and is used to transport the person, the wheels often pass through the bodily waste and track that waste on the floor as the person is transported from the bathing area.

*Clostridium difficile* (*C. Difficile* or *C. Diff*) is a deadly bacteria. It is the most serious cause of antibiotic-associated diarrhea (AAD) and can lead to pseudomembranous colitis, a severe infection of the colon. The *C. difficile* bacteria naturally reside in the body at non-toxic levels, normally. Transmission of *C. difficile* from one person to another often follows the vector from fecal matter to oral ingestion, such as can occur when fecal matter contaminates an object that is then touched by someone. The person has contaminated hands, which handles food and/or medicine, which causes the contamination to be ingested, thereby infecting the person. The infected person may experience overgrowth of *C. difficile*. The overgrowth is harmful because the bacterium releases toxins that potentially causes bloating, constipation, and diarrhea with abdominal pain, which may become severe. In elderly persons or those with frail immune systems, overgrowth of *C. difficile* often has severe, and sometimes deadly, consequences.

Many elderly or handicapped persons are not able to stand while being bathed. Such persons are often bathed while seated in a chair, such as a shower chair. Some elderly and handicapped persons have limited mobility and are able to stand for short periods, but are often cared for while seated. Elderly persons and handicapped persons benefit from being bathed by a caregiver when the person is in a seated position. Common bath chairs have a round seat or a seat that is open only in the front, making it difficult, if not impossible, for the caregiver to wash the perineal area of the person seated in the chair. Such a seated position makes it difficult for the caregiver to wash the perineum of the seated person because access by the caregiver is limited by the seated position and the seat. Accordingly, there is a need to be able to wash an elderly or handicapped person while that person is seated. Also, in a care facility with numerous persons needing care, there is a need to be able to transport such persons to a washing area without contaminating the care facility and the caregivers. Additionally, there is a need for caregivers to wash and otherwise care for persons without becoming contaminated by waste, including fecal matter, from the person being cared for.

BRIEF SUMMARY OF THE INVENTION

According to one embodiment of the invention, a seat in two parts with the parts configured to support the buttocks of a person sitting on the seat, the two parts of the seat separated by a gap sufficiently large to allow access, front and rear, to the perineum of the seated person for a caregiver to clean the perineum area, is provided. In this way, the caregiver is able to wash and clean the perineum area of a person who is not capable of caring for themselves.

In one embodiment, the seat is incorporated in a chair, such as a shower chair. The seat includes a left pad and a right pad with a gap between the two pads. At the front of the seat, the chair supports are configured to provide a space sufficient to allow a caregiver to reach between the seat pads and clean the genital area and the perineal area of a person seated in the chair. At the rear of the seat, the chair supports are configured to provide a space sufficient to allow a caregiver to reach between the seat pads and clean the anal area and perineum of a person seated in the chair. In this way, the chair does not restrict access to the perineum of the occupant of the chair.

In one such embodiment, the chair is configured to allow the chair to be positioned over a waste receptacle extending upwards from the floor. That is, the frame of the chair defines a volume that is sized to receive the waste receptacle and the volume is not bounded on the rear of the chair and on the bottom of the chair. For example, the chair has frame that is open on the rear of the chair by not having a left-to-right member below the seat support and rearward of the portion of the seat that normally corresponds to the body portion that exhausts human waste. In another such embodiment, the chair has a pair of rails under the seat that are spaced apart to receive and support a commode pot. The rails are suspended below the seat by a distance sufficient to provide clearance between the lip of the commode pot and the seat to prevent capturing or pinching any hanging body parts of the seat occupant.

In a further embodiment, one or both of the seat pads are movable. The seat pad pivots on the forward section and allows the rear section of the pad to move away from the other pad. In this way the buttocks of a person sitting on the seat are separated, thereby allowing a caregiver to better access the perineum through the separated cleavage of the buttocks. In one such embodiment, the seat pad has a pivot in the front and a pin in the rear that engages a slotted opening on a support member. The seat pad is spring biased to a normal position proximate the other seat. A handle connected to the seat pad allows a caregiver or other person to pull the seat pad away from the other pad, thereby separating the buttocks cleavage.

In another embodiment, the seat is incorporated in a fold-down platform. The pair of pads are supported in a horizontal position at a specified distance from a wall. The front of the seat is open and allows access to the genital area of the seat's occupant and the ventral perineum. For the embodiment where the seat is further supported with folding legs, any cross-brace is sufficiently far from the seat to not inhibit access to the area between the pair of pads. The rear of the seat is at a distance from the wall and hinge such that a caregiver can reach through the gap between the seat and the wall to access the anal area and the dorsal perineum.

According to one embodiment of the invention, a perineal washer is provided. The perineal washer is a device that receives a common spray nozzle and redirects the water spray toward the perineum of a seated person. In this way, a caregiver is able to apply water to the perineum of a person without manually directing water from a nozzle upwards, which normally results in exposing the caregiver to the person's bodily waste as the water drips onto the caregiver's hand and arm and runs down the caregiver's arm. The perineal washer has a receiver into which a nozzle of a hose sprayer fits. The receiver seals the nozzle and confines the majority of the water and water pressure to the perineal washer. The receiver is in fluid communication with a conduit that is elongated and extends under the seat. The end of the conduit has a nozzle or openings that direct the water from the nozzle upwards towards the perineum of the person sitting in the seat. The perineal washer includes articulation that allows the end of the conduit to sweep across the perineum.

BRIEF DESCRIPTION OF THE SEVERAL VIEWS OF THE DRAWINGS

The above-mentioned features of the invention will become more clearly understood from the following detailed description of the invention read together with the drawings in which:

FIG. 7 is a perspective view of one embodiment of a fold-up seat assembly and a perineal washer;

FIG. 8 is a side view of the fold-up seat assembly in the upright or folded position.

DETAILED DESCRIPTION OF THE INVENTION

Apparatus for bathing a seated person is disclosed. Elderly persons and handicapped persons benefit from being bathed by a caregiver when the person is in a seated position. As used herein, the A and B suffixes appended to a reference number indicate an embodiment of a component. When the reference number is used without the suffix, the generic component is being referenced.

Figure 1:
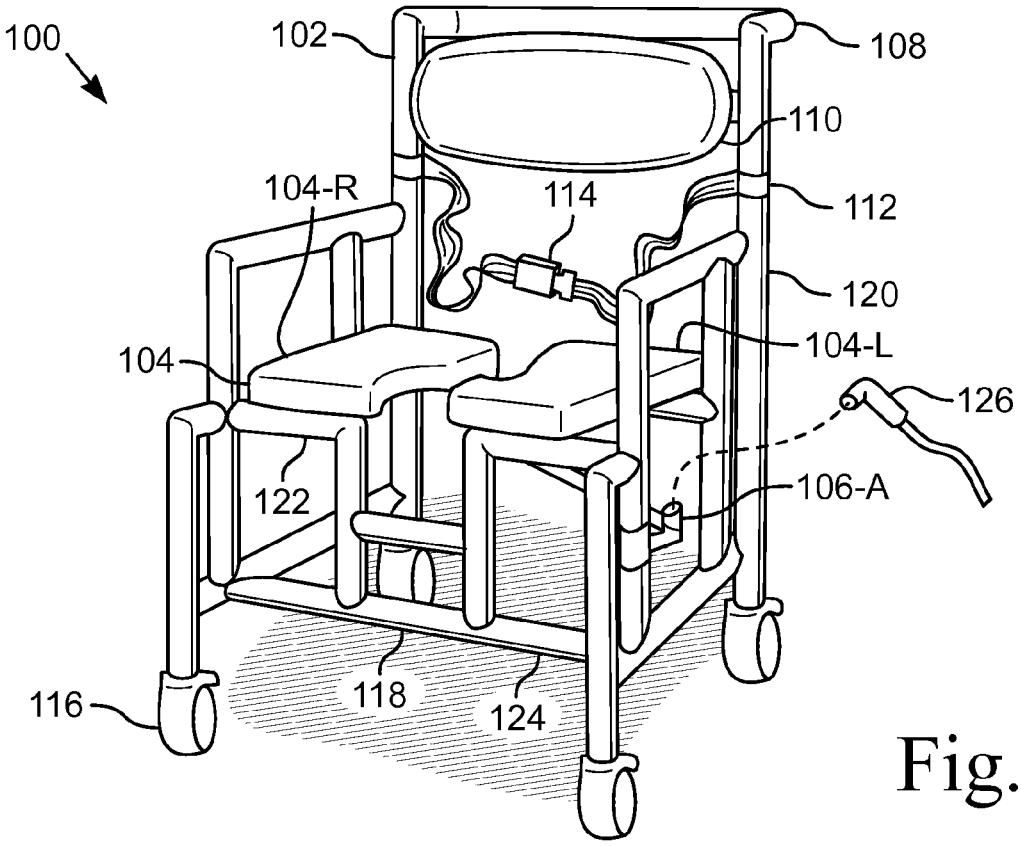
FIG. 1 is a perspective view of one embodiment of a wash system including a shower chair and a perineal washer.

FIG. 1 illustrates a perspective view of one embodiment of a wash system 100 including a shower chair 102 and a perineal washer 106-A that receives a nozzle 126 of a sprayer. The shower chair 102 includes a frame 118 that supports a seat 104 and a backrest 110. The frame 118 is a formed of a lightweight, but strong, material. For example, polyvinyl chloride (PVC) pipe is cut and joined with pipe fittings to assemble the illustrated frame 118 in a chair configuration. The illustrated frame 118 has a rectilinear configuration. In other embodiments, portions of the frame 118 are curved or follow an arcuate path.

Attached to the frame 118 is a seat 104. The seat 104 includes a pair of pads 104-L, 104-R supported at a height for use by an occupant of the chair 102. A seatbelt 112 with a buckle 114 is positioned to secure the occupant in the chair 102, such as when the occupant is transported in the chair 102. The rear supports 120 of the frame 118 define an open area between the supports 120 from the floor up to the bottom of the supports 122 of the seat 104. The volume under the seat 104 and its supports 122 is open and unobstructed, and the volume extends from the front support 124 to the rear supports 120. The volume is unobstructed on the bottom and rear sides and is bounded by the frame 118 on the front, top, and left and right sides.

The illustrated chair 102 is maneuverable. The chair 102 has wheels, or castors, 116 that allow the chair 102 to be moved as needed. A handle 108 is situated at the upper end of the rear vertical members 120 and allows a caregiver to maneuver the chair 102.

Figure 2:
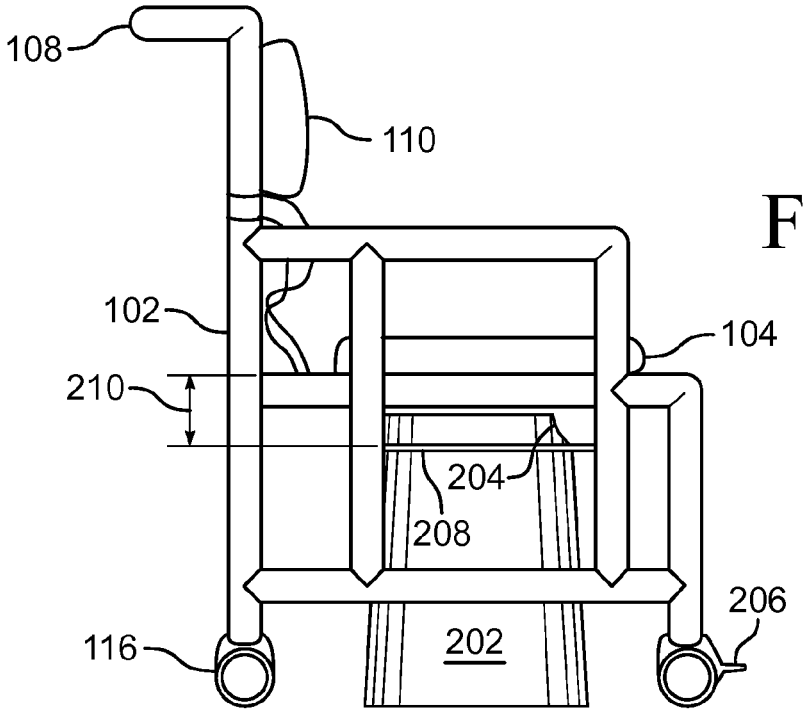
FIG. 2 is a side view of a wash system including a waste receptacle.

FIG. 2 illustrates a side view of a wash system 100 with a waste receptacle 202. The waste receptacle 202, in one embodiment, is a device such as disclosed in application Ser. No. 12/427,158, filed Apr. 21, 2009, and titled "Waste receiving device for incontinent persons," which is incorporated by reference. The waste receptacle 202 has a receiver at its upper end. The receiver has a strainer or filter that empties through a conduit that discharges near the bottom of the waste receptacle 202. The waste receptacle 202 is positioned over a floor drain, which receives the discharge from the waste receptacle 202. The waste receptacle 202 captures bodily waste from the occupant of the chair 102 and allows the waste to either flow to the floor drain or be captured in the receiver of the waste receptacle 202, such as when the waste is of size too large to pass through the floor drain. In various embodiments, the waste receptacle 202 is either freestanding or fixed to the floor.

The waste receptacle 202 is positioned over a floor drain in a bathing area. The chair 102 is positioned over the waste receptacle 202 by maneuvering the chair 102 so that the rear supports 120 of the frame 118 pass around the waste receptacle 202. The chair 102 is positioned such that if the occupant of the chair 102 becomes incontinent, the occupant will defecate into the waste receptacle 202, which will capture the waste. At least one of the wheels 116 of the chair 102 includes a wheel lock 206 that is foot operated after the chair 102 is in position. Operating the wheel locks 206 prevents the chair 102 from moving out of position after it is situated over the waste receptacle 202.

The waste receptacle 202 has a height that is slightly less than the inside height of the volume under the seat supports 122. The waste receptacle 202 has a recessed lip 204 on the upper end proximate the front of the chair 102. The edge of the recessed lip 204 is a distance 210 below the bottom of the seat 104 such that no dangling body parts of the occupant of the chair 102 are caught or pinched between the chair 102 and the waste receptacle 202 when the chair 102 is moved relative to the waste receptacle 202.

Supported below the seat 104 are a pair of rails 208 that are supported a distance 210 below the seat 104. The rails 208 support a commode pot 1002 under the seat 104.

In the embodiment illustrated in FIG. 2, the perineal washer 106 is positioned so as not to interfere with the waste receptacle 202 under the seat 104. In another embodiment, the waste receptacle 202 has a height that provides for a gap between the top of the waste receptacle 202 and the bottom of the seat supports 122. The gap is sufficiently large to allow the perineal washer 106 to be used with the chair 102 positioned over the waste receptacle 202.

Figure 3:
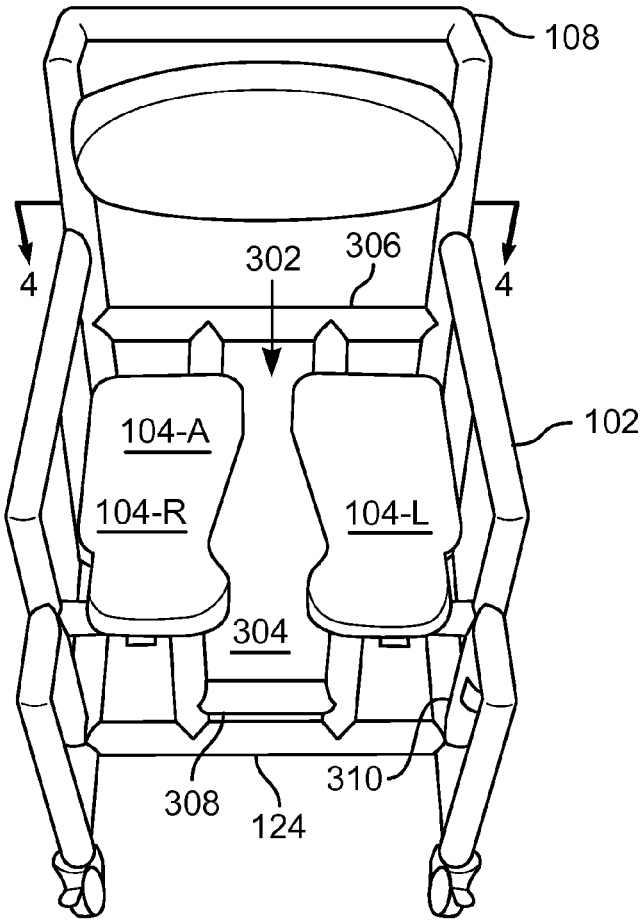
FIG. 3 is a perspective front top view of one embodiment of a shower chair.

FIG. 3 illustrates a perspective front top view of one embodiment of a shower chair 102. The seat 104-A has a pair of pads 104-L, 104-R that are separated from each other by a gap. The rear of the seat 104-A has a rear access area 302 between the rear cross-member 306 of the frame 118 and the seat 104-A. The front of the seat 104-A has a front access area 304 between the pair of pads 104-L, 104-R and between the pair of pads 104-L, 104-R and the cross-member 308.

Each pad 104-L, 104-R has a rear section that extends further toward the sides of the frame 118 than does the front section. The wider rear section of the pads 104-L, 104-R is the portion of the seat 104-A where the buttocks of the occupant of the chair 102 are more likely to spread and be supported by the additional surface area of the seat pads 104-L, 104-R. That is, the wider seat pads 104-L, 104-R provide for an increased sitting area for the occupant of the chair 102.

Figure 4:
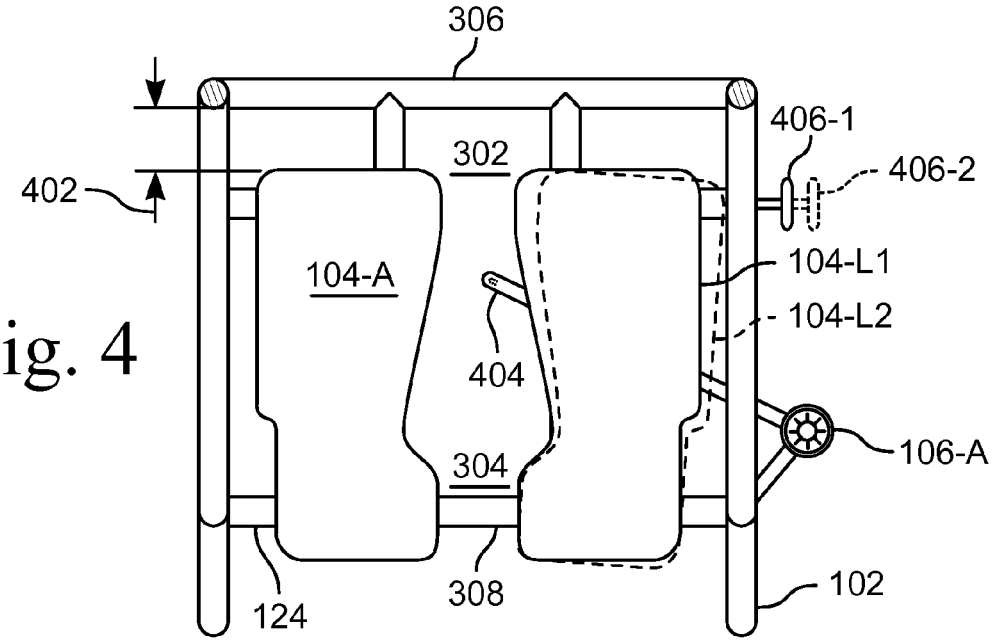
FIG. 4 is a top plan view of a shower chair and a perineal washer.

FIG. 4 illustrates a top plan view of a shower chair 102 and a perineal washer 106. The rear access area 302 is defined by a gap 402 between the rear cross-member 306 and the rear of the seat 104-A. In one embodiment, the gap 402 is approximately eight inches, which is sufficient to receive the hand and/or arm of the caregiver when the caregiver reaches behind the occupant of the chair 102 to manually wipe and wash the perineal area of the occupant. The gap 402 is also sufficiently sized to receive the caregiver's hand when holding a washcloth and/or other cleaning device.

The front access area 304 is defined by the separation of the seat pads 104-L, 104-R and the vertical gap between the cross member 308 and the seat 104-A. With a person sitting on the seat 104-A, the occupant's legs extend from the front of the seat 104-A. In order for a caregiver to wipe and wash the genital area and the ventral perineal area, the caregiver must reach between the occupant's legs, above the cross-member 308, and between the seat pads 104-L, 104-R. The vertical gap between the cross-member 308 and the seat 104-A and the gap between the seat pads 104-L, 104-R is sufficient for the caregiver to reach to the areas to be washed by the caregiver.

The perineal washer 106-A is attached to a vertical member 310 of the frame 118. The perineal washer 106 includes an elongated conduit 404 that has an end that is movable to direct or spray water between the pair of seat pads 104-L, 104-R. A spray nozzle 126 for washing the person engages the perineal washer 106, which redirects the fluid output from the nozzle 126 to the perineal area of the occupant of the chair 102.

In the illustrated embodiment, one of the seat pads 104-L is movable between a normal position 104-L1 and a separated position 104-L2 by operation of a handle 406. The rear portion of one seat pad 104-L moves sideways, changing the width of the gap between the two seat pad 104-R, 104-L at the rear of the seat 104. When a person sits on the seat 104, each cheek of the buttocks rests on one of the seat pads 104-R, 104-L. One seat pad 104-L pivots such that the rearmost portion forms a wider gap between the two seat pads 104-R, 104-L. The separation of the pads 104-R, 104-L also separates the cheeks of the buttocks, allowing a caregiver easier access to the perineum of the occupant. The pads 104-R, 104-L are separated by the caregiver pulling the handle 406 from a normal position 104-L1 to an extended position 406-L2. In one embodiment, the handle 406 is spring loaded and the caregiver must continue pulling the handle 406-2 while cleaning the perineum. In another embodiment the handle 406 latches in the extended position 406-2, thereby allowing the caregiver to use both hands to clean the perineum.

Figure 5:
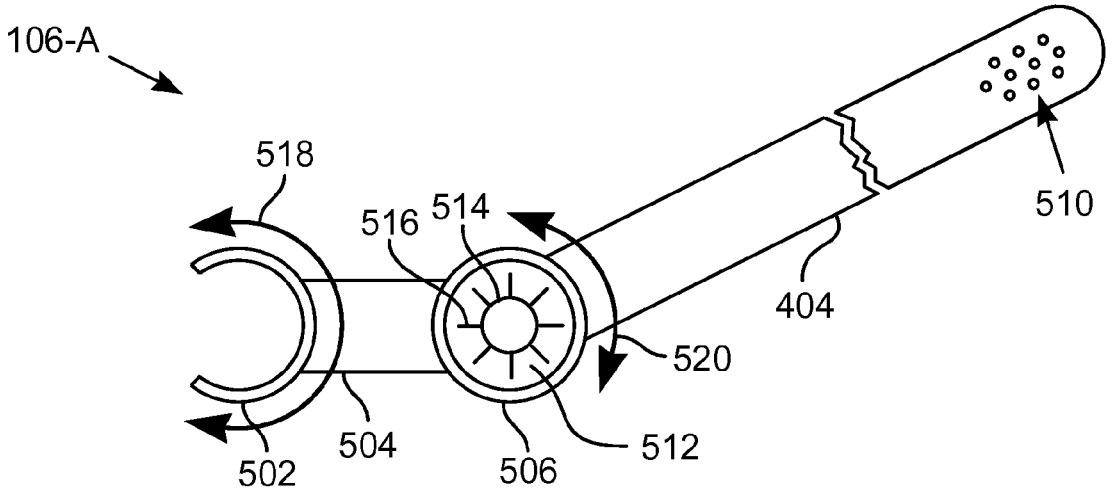
FIG. 5 is a top plan view of one embodiment of a perineal washer.
Figure 6:
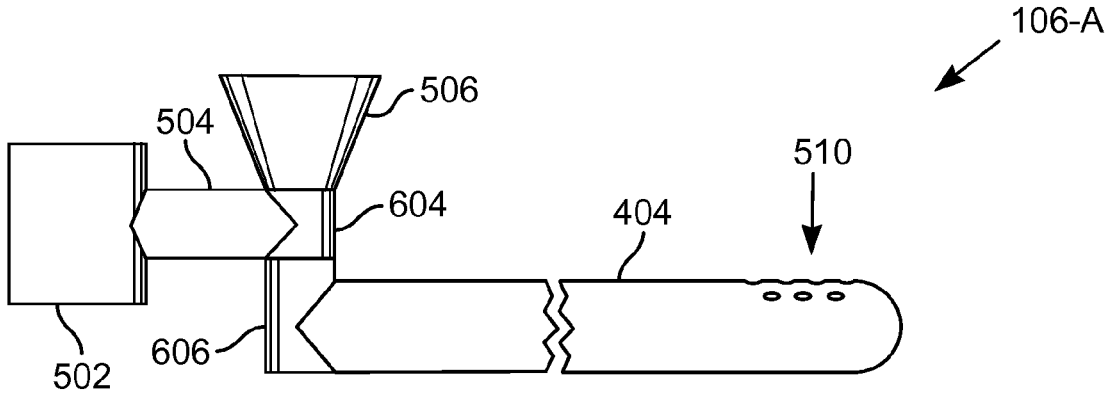
FIG. 6 is a side view of the perineal washer.

FIG. 5 illustrates a top plan view of one embodiment of a perineal washer 106-A. FIG. 6 illustrates a side view of the perineal washer 106-A. The illustrated embodiment of the perineal washer 106-A includes a clamp 502 that has a C-shaped configuration that fits partially around a vertical member 310 of the chair frame 118. The C-shaped configuration of the clamp 502 allows the perineal washer 106-A to rotate 518 around the longitudinal axis of the vertical member 310. The clamp 502 is releasably connectable to the vertical member 310 and is readily repositioned on the member 310 or on another vertical member of the frame 118.

Extending from the clamp 502 is an attachment member 504 connected to a swivel 604. Above the swivel 604 is a receiver 506 and below the swivel 604 is connector 606. The connector 606 supports the elongated conduit 404, which has multiple openings 510 at the end, forming a nozzle to spray water upward. The receiver 506 is in fluid communication with the connector 606, and both rotate 520 together relative to the swivel 604, which in the illustrated embodiment is a sleeve that surrounds the conduit connecting the receiver 506 to the connector 606.

The receiver 602 in the illustrated embodiment is a funnel-shaped device that receives a spray nozzle 126 attached to a hose. In other embodiments, the receiver 506 is cylindrical and sized to mate with the nozzle 126. One such embodiment is illustrated in FIG. 8. The receiver 506 includes a seal 512, which in the illustrated embodiment is a resilient material with a central opening 514 and radial slits 516 that allow the opening 514 to expand to receive the spray end of the nozzle 126. The tip of the nozzle 126 is pushed against the seal 512 such that the opening 514 is enlarged by the resilient material between the radial slits 516 deforming. After the tip of the nozzle 126 is inserted in the seal 512, the resilient material grips the nozzle 126 as the material between the radial slits 516 engages the nozzle 126.

The perineal washer 106-A has two articulated joints. The clamp 502 has a partial cylindrical shape that engages and rotates 518 around the longitudinal axis of a vertical member 310. The receiver 506, connector 606, and elongated conduit 404 rotate 520 relative to the attachment member 504 and the swivel 604. The articulation permits the end of the elongated conduit 404 with the openings 510 to be positioned under the perineum of the occupant of the chair 102.

In use, the nozzle 126 from a sprayer is inserted in the receiver 506 such that the nozzle 126 engages the seal 512. For the condition where the seal 512 grips the nozzle 126, the caregiver rotates the nozzle about a vertical axis to cause the conduit 404 to rotate 520 into a desired position under the seat 104. The caregiver also translates the nozzle 126 to cause the washer 106-A to rotate 518 about the vertical member 310 if such is needed to position the conduit 404. When the conduit 404 and the spray openings 510 are in position, the caregiver operates the nozzle 126 to direct fluid through the nozzle 126, into the perineal washer 104-A, and out the spray openings 510. The fluid is sprayed upwards toward the perineum of the occupant of the chair 102. The caregiver manipulates the nozzle 126 to position the spray openings 510 where desired as the perineal area is washed. In the embodiment where the seal 512 does not grip the nozzle 126 tightly enough to allow the perineal washer 104-A to be positioned, the caregiver grips the nozzle 126 and the receiver 506 to manipulate both together to direct the spray from the openings 510 where desired.

FIG. 7 illustrates a perspective view of one embodiment of a fold-up seat assembly 700 and another embodiment of a perineal washer 106-B. In another embodiment, the hinge 704 is attached directly to the wall 804. The fold-up seat assembly 700 is a chair in which the wall provides a support for the rear of the seat assembly 700. The fold-up seat assembly 700 has two positions, a lowered position and an upright position. The lowered position is illustrated in FIG. 7 and is suitable for an occupant to sit on the seat 104-B, such as when the person is bathing in a shower or bathtub. The upright position is the folded position and positions the sitting surface of the seat 104-B parallel to the flat surface 702 and the wall 804. FIG. 8 illustrates a side view of the fold-up seat assembly 700 in the upright or folded position.

A flat surface 702, such as a mounting plate on a wall 804, provides an attachment for a hinge 704 and a perineal washer 106. The hinge 704 is attached to the flat surface 702 and to a pair of arms 708 that form part of a frame that support the seat 104-B. The arms 708 rotate about the axis of the hinge 704 to swing the seat 104-B upward against the wall. The arms 708 support the seat 104-B a selected distance from the flat support 702 so as to provide for a rear access area 302. The area 302 is dimensioned to allow the caregiver to access the anal area and the dorsal perineal area of the occupant of the seat 104-B.

In the illustrated embodiment, the front of the seat 104-B is supported in the lowered position by a pair of legs 710 that are attached to the bottom of the seat 104-B at a hinge 802. The legs 710 are connected with a cross-member 712 that provides lateral support for stability of the legs 710. The front access area 304 is defined by the gap between the cross-member 712 and the seat 104-B. The gap has a dimension that is sufficient to allow a caregiver to access the genital area and the ventral perineal area of an occupant of the seat 104-B. When the fold-up seat assembly 700 is moved from the lowered position to the folded position, the legs 710 remain vertically oriented as they swivel at the hinge 802 where the legs 710 connect to the seat 104-B.

The seat 104-B includes a pair of pads. The illustrated embodiment shows a seat 104-B that is substantially rectangular in outline with a gap extending from the front to the rear of the seat 104-B. In other embodiments the seat 104-B has an elliptical or other configuration that supports an occupant while providing access to the perineal area of the occupant.

Figure 9:
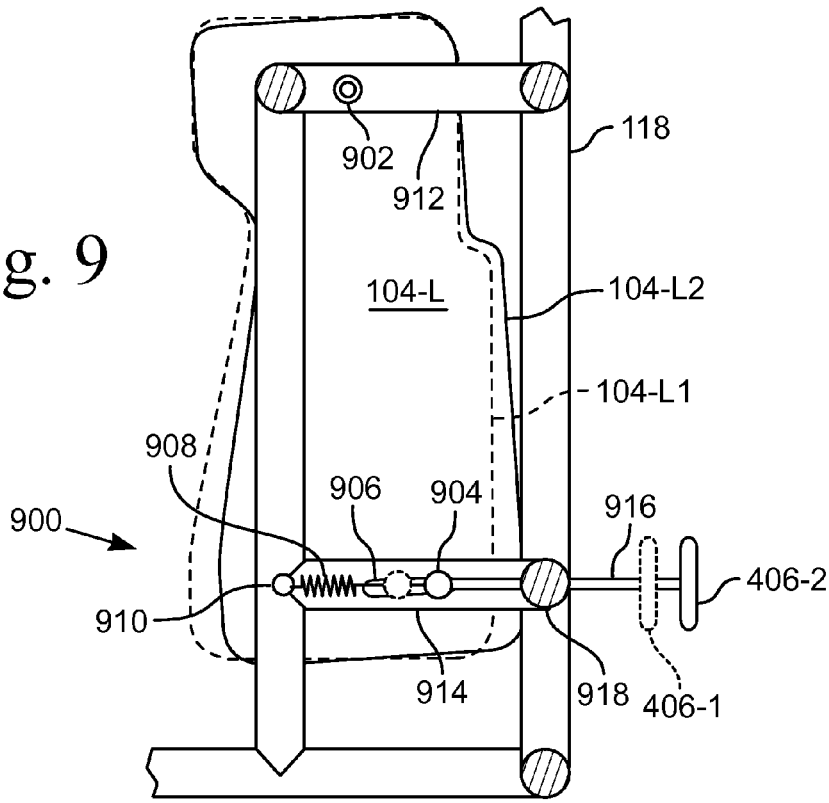
FIG. 9 is a partial bottom view showing a seat pad and one embodiment of a pad pivot mechanism.

FIG. 9 illustrates a partial bottom view showing a seat pad 104-L and one embodiment of a pad pivot mechanism 900. The seat pad 104-L has a pivot 902 attaching the front portion of the pad 104-L to the chair frame 118. In one embodiment, the pivot 902 is a fastener securing the pad 104-L to a front seat pad support 912 with a washer acting as a bearing.

The rear of the seat pad 104-L is above a rear seat pad support 914 that has an elongated, or slotted, opening 906. A pin 904 extends from the bottom of the seat pad 104-L through the slotted opening 906. The rear portion of the seat pad 104-L moves laterally between the normal position 104-L1 and the separated position 104-L2. In one embodiment, the seat pad 104-L is held captive to the frame 118 by a distal end of the pin 904 that is larger than the narrowest portion of the slotted opening 906, thereby preventing the pin 904 from being pulled through the slotted opening 906. The pin 604 is attached to a fixed point 910 on the frame 118 by a spring 908. The spring 908 biases the seat pad 104-L to the normal position 104-L1.

In one embodiment the shaft 916 of the handle 406 runs through a vertical frame member 918 and is attached to the pin 904. The through-opening in the vertical frame member 918 provides lateral support for the handle 406. With the handle 406-1 in the normal position, the seat pad 104-L1 is in the normal position, which is the position with the rear portion of the seat pads 104-R, 104-L closest together. With the handle 406-2 in the extended position, the seat pad 104-L2 is in the separated position, which is the position with the rear portion of the seat pads 104-R, 104-L farthest apart. The spring force of the spring 908 is sufficient to pull the seat pads 104-R, 104-L together with an occupant on the seat 104.

Figure 10:
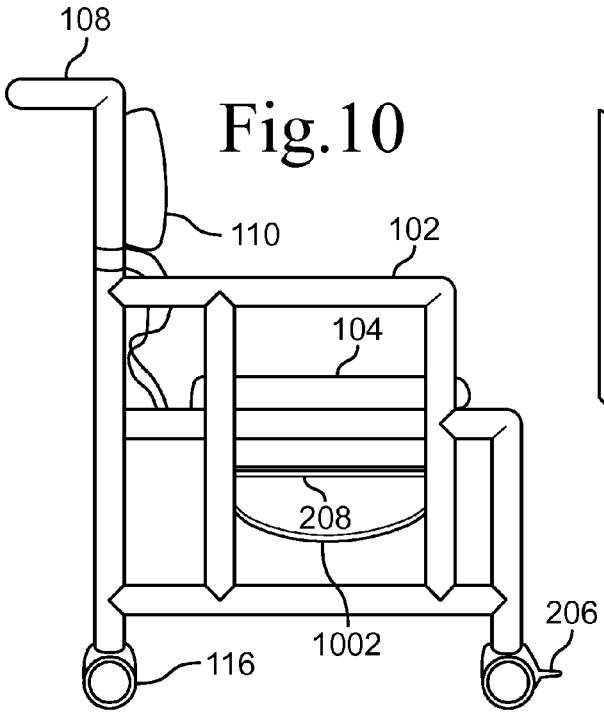
FIG. 10 is a side view of one embodiment of a shower chair with a commode pot.
Figure 11:
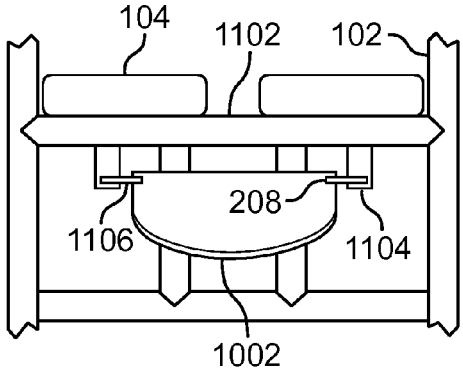
FIG. 11 is a partial rear view of a shower chair of FIG. 10.

FIG. 10 illustrates a side view of one embodiment of a shower chair 102 with a commode pot 1002. FIG. 11 illustrates a partial rear view of a shower chair of FIG. 10. Under the seat 104 is a pair of parallel rails 208. The rails 208 are suspended under the seat 104 by stanchions 1104 positioned adjacent the ends of the rails 208. The rails 208 are spaced apart to allow a commode pot 1002 to be slid between the rails 208. In one such embodiment, the rails 208 are separated sufficiently to allow the waste receptacle 202 to fit under the seat 104 and between the pair of rails 208.

The commode pot 1002 is configured to engage the pair of rails 208. The pot 1002 has a lip or slot 1108 on each side that engages the corresponding rail 208. In this way the pot 1008 is supported under the seat 104 and is available to collect any waste ejected from the occupant of the seat 104.

The rear of the chair 102 is open to allow the commode pot 1002 to be removed by sliding the pot 1002 rearward along the rails 208. Because of the distance 210 between the seat bottom and the top of the pot 1002, the pot 1002 is removable without harmfully encountering any dangling body parts of the occupant of the seat 102. For example, the testicles and penis of a male occupant may hang below the seat 104. When the commode pot 1002 is removed, the distance 210 is sufficient that the male occupant's hanging body parts are not pinched or otherwise caught by the pot 1002. In one such embodiment, the distance 210 between the seat 104 and the commode pot 1002 is approximately 3 to 5 inches.

The full perineal wash system 100 includes various functions. The function of providing access to the perineum of a person who is sitting is implemented, in one embodiment, by the seat 104 with a pair of pads 104-L, 104-R that are separated from each other and from adjacent support members with a gap sized to allow a caregiver to reach the genital area and the ventral perineal area from the front of the seat 104 and the anal area and the dorsal perineal area from the rear of the seat 104.

The function of minimizing contamination with waste and fecal matter is implemented, in one embodiment, by a shower chair 102 that has a frame 118 configured to allow a waste receptacle 202 to fit under the seat 104. The frame 118 is open in the rear, allowing the chair 102 to be backed up to position the chair 102 over the waste receptacle 202.

The function of moving a seat assembly 700 between an upright position and a lowered position is implemented, in one embodiment, by a seat 104 attached to a hinge 704 on a surface 702 with the rear of the seat 104 supported a selected distance 402 from the hinge 704.

The function of separating the seat pads 104-R, 104-L is implemented, in one embodiment, by the pad pivot mechanism 900, which allows the rear portion of at least one seat pad 104-L to move laterally away from the other seat pad 104-R.

From the foregoing description, it will be recognized by those skilled in the art that a full perineal wash system 100, 700 has been provided. The system 100, 100' allows the perineum of a seated person to be washed by a caregiver without the seated person having to get up from the seated position or being otherwise manipulated to remove a body portion from the seat 104. The system 100, 100' provides a washer 106 that sprays a liquid on the perineum of a seated person while minimizing the contamination of the caregiver by allowing the caregiver to direct the spray of liquid from a distance. The system 100, 100' accommodates a portable chair 102, such as a shower chair, and a fixed chair, such as a fold-up seat assembly 700 or a fixed chair.

In one embodiment, an apparatus for washing a perineum of a seated person, said apparatus comprising: a seat having an opening in a central portion of said seat; a receiver proximate said seat, said receiver configured to receive a nozzle from a sprayer; and a conduit in fluid communication with said receiver; said conduit being elongated with a length sufficient to reach from said receiver to said opening in said seat, said conduit having a distal end with at least one orifice, said conduit repositionable such that said distal end sweeps through a portion of said opening in said seat.

In one such embodiment, said receiver includes a seal with an opening and a plurality of radial slits extending from said opening, said seal configured for engagement with said nozzle.

In another such embodiment, said seat includes a first pad and a second pad separated by a gap, said gap extending from a front of said seat to a rear of said seat, said opening in said seat coextensive with said gap, said gap having a width throughout a length of said gap wherein said width is sufficient to accommodate a human hand.

In yet another such embodiment, said seat is attached to a chair with wheels, said chair configured to transport the seated person from a first location to a second location. In one such embodiment, said chair has a frame configured to receive a waste receptacle extending upward from a floor, said chair positionable over said waste receptacle with a receptacle receiver positioned below and adjacent to said opening in said seat.

In still another such embodiment, said seat is attached to a frame configured to pivotably move said seat between a first position that is substantially horizontal and a second position that is substantially vertical. In one such embodiment, said frame is connected to a hinge, said hinge attached to a stationary support.

In one embodiment, an apparatus providing access to a perineum of a seated person, said apparatus comprising: a seat having an opening in a central portion of said seat; and a receiver positioned a selected distance below said seat, said receiver configured to releasably hold a container dimensioned and configured to receive bodily waste from the seated person, said selected distance being great enough to avoid capturing a dangling body part between said seat and said container. In one such embodiment, said seat includes a first pad and a second pad separated by a gap, said gap extending from a front of said seat to a rear of said seat, said opening in said seat coextensive with said gap, said gap having a width throughout a length of said gap wherein said width is sufficient to accommodate a human hand.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus providing access to a perineum of a seated person, said apparatus comprising:

a first pad;

a second pad spaced apart from said first pad with a gap therebetween, said first and second pads defining a seat with said gap defining a through-passage extending from a front of said seat to a back of said seat, said front of said seat defined as a front edge of said seat, and said back of said seat defined as an opposite edge of said seat;

a frame attached to said first pad and said second pad wherein said seat is supportable at a height suitable for the seated person to sit thereupon, said frame further defining said through-passage to extend from said gap downward from a bottom of said seat sufficiently to accommodate a human arm reaching into said through-passage, said first pad, said second pad, and said frame defining a first access area and a second access area, said first access area dimensioned and configured to allow access by another person to a ventral perineal area of the seated person, said second access area dimensioned and configured to allow access by said other person to a dorsal perineal area of the seated person;

a receiver having a seal, said receiver configured to receive a spray nozzle; and a conduit in fluid communication with said receiver, said conduit being disposed under said seat, said conduit being elongated with a distal end, said distal end having a plurality of openings configured to direct said fluid from said nozzle, through said conduit, and upwards into said gap, said distal end of said conduit being movable under said gap.

2. The apparatus of claim 1 wherein said first pad is movable between a first position and a second position, said second position defined by a rear gap between said first and second pads that is wider then when said first pad is in said first position.

3. The apparatus of claim 2 wherein said first pad includes a pivoting connection to said frame, said pivoting connection proximate a front of said first pad, said first pad including a pin engaging a slotted opening in said frame whereby a rear portion of said first pad is movable laterally.

4. The apparatus of claim 1 further including a plurality of wheels attached to said frame, said frame including a handle configured to push and pull said frame on said wheels to move said apparatus from a first location to a second location.

5. The apparatus of claim 4 wherein said frame includes an access port extending from said seat downward at a rear of said seat whereby said frame is positionable over a waste receptacle extending upward from a floor drain.

6. The apparatus of claim 1 further including a hinge attached to said frame, said seat pivoting about said hinge between a first position and a second position, said first position being a folded position with said seat being substantially vertical, said second position with said seat substantially horizontal and at said height suitable for said person to sit thereupon.

7. The apparatus of claim 1 wherein said seal has an opening with a plurality of radial slits extending from said opening and said seal is configured to grip said nozzle and minimize leakage of fluid from said nozzle.

8. The apparatus of claim 1 further including a pair of rails positioned a selected distance below said seat, said pair of rails configured to releasably hold a container dimensioned and configured to receive bodily waste from the seated person.

9. An apparatus providing access to a perineum of a seated person, said apparatus comprising:

a seat having a first pad and a second pad spaced apart from said first pad with a gap therebetween, said gap extending from a front of said seat to a rear of said seat, said gap not obstructed at said front and at said rear; and a frame supporting said first pad and said second pad wherein said seat has a height suitable for the seated person to sit thereupon, said seat and said frame defining a first access area at said front of said seat, said first access area including said gap at said front of said seat and extending below a bottom of said seat with said first access area being dimensioned and configured such that a human hand fits through said first access area to reach a central portion of said seat;

said seat and said frame defining a second access area at said rear of said seat, said second access area including said gap at said rear of said seat and extending below a bottom of said seat with said second access area being dimensioned and configured such that said human hand fits through said second access area to reach said central portion of said seat.

10. The apparatus of claim 9 wherein said first pad is movable between a first position and a second position, said gap at said rear of said seat being wider with said first pad in said second position then when said first pad is in said first position.

11. The apparatus of claim 10 wherein said first pad includes a pivoting connection to said frame, said pivoting connection proximate said front, said first pad including a pin engaging a slotted opening in said frame whereby a rear portion of said first pad is movable laterally.

12. The apparatus of claim 9 further including a plurality of wheels attached to said frame, said frame including a handle configured to move said apparatus from a first location to a second location.

13. The apparatus of claim 9 further including a hinge attached to said frame, said seat pivoting about said hinge between a first position and a second position, said first position being with said seat being substantially vertical, said second position being with said seat substantially horizontal and at a height suitable for said person to sit thereupon.

14. The apparatus of claim 9 further including a washer having a receiver with a seal, said receiver configured to receive a spray nozzle; and a conduit in fluid communication with said receiver, said conduit being disposed under said seat, said conduit being elongated with a distal end, said distal end having a plurality of openings configured to direct said fluid from said spray nozzle, through said conduit, and upwards into said gap.

15. The apparatus of claim 14 wherein said distal end of said conduit is selectively positionable under said gap.

16. An apparatus providing access to a perineum of a seated person, said apparatus comprising:

a seat having a first pad and a second pad spaced apart from said first pad with a gap therebetween, said gap extending from a front of said seat to a rear of said seat, said gap unobstructed at said front and at said rear of said seat; and a frame supporting said first pad and said second pad wherein said seat has a height suitable for the seated person to sit thereupon, said frame and said seat defining a passageway extending from said gap downward below a bottom of said seat, said passageway dimensioned and configured to allow access and passage of a human arm from said front of said seat to a ventral perineal area of the seated person, said passageway dimensioned and configured to allow access and passage of a human arm from said rear of said seat to a dorsal perineal area of the seated person.

17. The apparatus of claim 16 further including a washer having a receiver with a seal, said receiver configured to receive a spray nozzle; and a conduit in fluid communication with said receiver, said conduit being disposed under said seat, said conduit being elongated with a distal end, said distal end having a plurality of openings configured to direct said fluid from said spray nozzle, through said conduit, and upwards into said gap.

18. The apparatus of claim 17 wherein said distal end of said conduit is selectively positionable under said gap.

19. The apparatus of claim 16 further including a pair of rails positioned a selected distance below said seat, said pair of rails configured to releasably hold a container dimensioned and configured to receive bodily waste from the seated person.

* * * * *